United States Patent [19]

Schlosser

[11] Patent Number: 4,814,026

[45] Date of Patent: Mar. 21, 1989

[54] METHOD OF PRODUCING COMPOSITE WELDED COMPONENTS

[75] Inventor: Heinz Schlosser, Cologne, Fed. Rep. of Germany

[73] Assignee: Ford Motor Company, Dearborn, Mich.

[21] Appl. No.: 10,366

[22] Filed: Feb. 3, 1987

[51] Int. Cl.[4] ..... C21D 1/72

[52] U.S. Cl. ..... 148/16.5; 148/127; 148/902

[58] Field of Search ..... 148/127, 148, 149, 902, 148/904, 907, 910, 145, 142, 16, 16.5; 428/600, 544, 610

[56] References Cited

U.S. PATENT DOCUMENTS

| | | | |
|---|---|---|---|
| Re. 18,661 | 11/1932 | Davis | 148/148 |
| 871,932 | 11/1907 | Hansen | 148/148 |
| 1,859,623 | 5/1932 | Gregg | 148/149 |
| 2,197,039 | 4/1940 | Gottlieb | 148/127 |
| 2,295,777 | 9/1942 | Denneen et al. | 148/148 |
| 2,788,302 | 4/1957 | Dew | 148/127 |
| 2,821,494 | 1/1958 | Walker | 148/149 |
| 3,557,423 | 1/1971 | Wolfe et al. | 145/127 |
| 3,578,512 | 5/1971 | Funakubo | 148/149 |
| 4,280,566 | 7/1981 | Breen | 148/902 |
| 4,323,404 | 4/1982 | Sawada et al. | 148/902 |

FOREIGN PATENT DOCUMENTS

| | | | |
|---|---|---|---|
| 2920719 | 5/1979 | Fed. Rep. of Germany . | |
| 113836 | 9/1980 | Japan | 148/149 |

OTHER PUBLICATIONS

Metals Handbook, vol. 4 (Heat Treating, pp. 163–171), vol. 6, (Welding, pp. 60–72), American Society for Metals, 1981, 1983.

*Primary Examiner*—John J. Zimmerman

*Attorney, Agent, or Firm*—Joseph W. Malleck; Roger L. May

[57] ABSTRACT

In the production of composite welded components the workpieces are joined together only partially machined and are then jointly subjected to a heat treatment for hardening their surface, the welding gap formed by their contact surfaces being previously covered with an agent which prevents carbonization of the contact surfaces as a machining-free preparation for welding with electron or laser beams following the heat treatment after individual finishing of the workpieces.

5 Claims, 1 Drawing Sheet

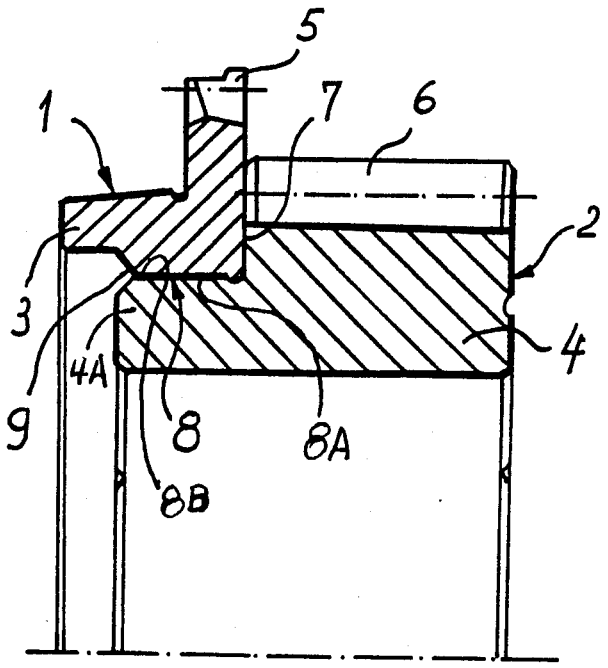
5
1
7
6
2
3
4
4A
9
8
8A
8B

METHOD OF PRODUCING COMPOSITE WELDED COMPONENTS

BACKGROUND OF THE INVENTION

1. Technical Field

This invention relates to the art of producing composite welded components joined together from at least two metal workpieces, which workpieces must be surface hardened.

2. Description of the Prior Art

In the production of composite welded components, the practice has been to first mechanically finish each of the two workpieces, separately, and then heat treat each of the workpieces, also separately, to harden their surface. The carbonization of the surface (which occurs during the heat treatment to improve the properties of the material) will extend over the contact surfaces of the workpieces, which contact surfaces must be brought together for welding. If welding is carried out with electron beams, to promote fusion and vaporization of the metal, it is necessary to remove the carbonized layer on the contact surfaces of the workpieces before such welding. The hardened workpieces must therefore be machined in a sub-step of the preceding finishing process, or in a correspondingly separate finishing process for additional individual machining, in order that the contact surfaces may have a welding zone that permits satisfactory welding. For welding carried out by means of laser beams, layers of this type (ones which are carbonized during a preceding heat treatment of the workpieces) must also be removed from the welding zone, again beforehand. In the case of manufacturing composite gearwheels, for example, which are required for vehicle transmissions, this undesirably necessitates extra time and high cost.

German Pat. No. DE-PS 2920719 discloses a method which attempts to inhibit hardening during heat treatment of a welding zone, but does so in a manner that is cumbersome, costly, and does not insure close tolerances of the workpieces after heat treatment. This German patent requires use of covers and blocks for maintaining the inner bore of a gear free of hardening to facilitate welding. The extra handling and use of blocks prevents simplification and reduction of costs, and does little to inhibit distortion of the parts during heat treatment.

SUMMARY OF THE INVENTION

The invention attains the object of providing a method of producing surface hardened composite welded components by means of electron or laser beams while eliminating a second machining of the contact surfaces after hardening.

The method comprises (i) machining only the weldable contact surfaces of mateable workpieces, (ii) intimately joining the workpieces together prior to heat treatment with the weldable contact surfaces mated to define a welding zone, (iii) sealing off the welding zone by use of a nonhardening, removable agent, (iv) hardening the surfaces of the joined workpieces i.e., as by gas carburization, (v) separating the workpieces and machining the the workpieces to the desired configuration, and (vi) rejoining said workpieces and fusing together said contact surfaces by welding. When the invention is applied primarily to axially symmetrical workpieces, such as in composite gearwheels, the workpieces need only be partially machined so that they can be loosely joined together on their contact surfaces forming the subsequent welding zone for a common heat treatment. In this connection, the purpose of this previous partial machining of the workpieces is only that the welding zone formed by their subsequent joining on the contact surfaces on both sides can be covered in a simple manner with an agent which prevents carbonization of the contact surfaces during the subsequent heat treatment. For this purpose it is only necessary, for example, for the contact surfaces, prepared by this previous partial machining of the workpieces, to be provided at the same time with bevels, radii, or other recesses on their edges so that each end of the welding zone which is "open" with respect to the contact surfaces may thus have an essentially groove shaped covering surface over which can be spread, after the workpieces have been joined, the agent preventing carbonization for an outwardly sealing covering of the contact surfaces.

SUMMARY OF THE DRAWING

FIG. 1 is a longitudinal sectional view of a composite gearwheel utilizing the method of this invention.

DETAILED DESCRIPTION AND BEST MODE

The application of the method, according to the invention, to the production of composite gearwheels, which is preferred, is briefly described below with reference to FIG. 1, which is a longitudinal sectional view of one embodiment of a composite gearwheel provided for a motor vehicle transmission.

The composite gearwheel illustrated in the drawing comprises two gearwheels 1 and 2 which are arranged coaxially, and the hub of each (3 and 4 respectively) is provided with a toothed rim (5 and 6 respectively). The hub 3 of gearwheel 1 is mounted on an axially projecting portion 4A of reduced diameter of the hub 4 of the second gearwheel 2 and in a stopped position against shoulder 7 so that the two gearwheels 5 and 6 have an axial series arrangement desired for engagement with mating gears of the transmission.

The hubs 3 and 4 of the two gearwheels 1 and 2 are welded together along a welding zone 8 which extends essentially over the length of the axially projecting portion 4A of reduced diameter of hub 4 and along the radial interior of hub 3. At the end of the welding zone 8, axially remote from the shoulder 7, a groove shaped covering surface 9 is provided. The groove is produced by bevelling, rounding off, or otherwise recessing the associated edges of the two contact surfaces of the hubs 3 and 4 (radial interior of hub 3 designated 8A and radial exterior of projecting portion 4A designated 8B) and which, therefore, enlarges the "open" end of the welding zone 8 on the end faces of the two hubs 3 and 4 lying in a common radial plane. The groove shaped covering surface 9 is provided in order to prevent carbonization of the two contact surfaces (8A and 8B) of the hubs 3 and 4 during a common heat treatment of the two gearwheels 1 and 2 carried out before the individual finishing and the subsequent welding so as to harden the surface. For this purpose, this covering surface is then covered with an agent preventing such carbonization, such as, for example, the trade product available under the name "CONDURSAL." Such agent is a high temperature resistant mixture of sand and oil. The agent can be any material that is removable after heat treatment and prevents ingress of the carburizing gas to the welding zone. Such agent can be selected from the group consisting of Condursal, high temperature microcrystalline wax, high temperature resistant lacquer, and ceramic paint. The other axial end of the welding zone 8 is adequately covered by the stopped position of the hub 3 on the shoulder 7 of the hub 4 to prevent carbonization of the two contact surfaces of the hubs 3 and 4 from this end. Thus, in this embodiment of a composite gearwheel, it is not necessary to take precautions at that end; however, if the workpiece design does not so protect, a similar groove would have to be provided at this end.

For the embodiment of a composite gearwheel as described above, therefore, only the two gearwheels 1 and 2, formed first of all as castings, need be partially machined in order to form the contact surfaces forming the welding zone 8 and the groove shaped covering surface 9 on the hub 3 and 4. The gearwheels are then joined together in the arrangement illustrated in the drawing and are then jointly subjected to the heat treatment, the covering surface 9 being covered with the agent preventing carbonization of the contact surfaces prior to the said heat treatment. After the heat treatment, the two gearwheels 1 and 2 are separated from one another again in order to allow them to be finished individually. The two contact surfaces are thus excluded from the finishing so that during the latter only the toothed rims 5 and 6 are machined to size. After the said finishing, the gearwheels are then joined together again in the arrangement which is illustrated in the drawing and in which they are finally welding together by means of electron or laser beams.

Thus, during the heat treatment carried out jointly on the joined workpieces for hardening the surface, carbonization of the contact surfaces forming the welding zone is prevented so that these surfaces need not be machined again later. At the same time, for the heat treatment of gearwheels arranged one above the other by their hubs, there is the advantage that during the heat treatment the inwardly situated hub of one gearwheel functions, with respect to the outwardly situated hub of the second gearwheel, as a mandrel, limiting its retardation so that during the finishing which follows the common heat treatment of the two gearwheels the contact surfaces, present at the welding zone, need not be machined again. If the gearwheels are released from one another again after the heat treatment (which action can be performed either manually or by a simple pressing-off apparatus) for the individual finishing, including their contact surfaces, they can subsequently be clamped in a simple, uniform manner to the workpiece holder of the machine tools, by means of which their toothed rim, in particular, is then machined to the respective size by grinding.

When this finishing has been carried out in series on the workpieces, the workpieces are joined together again in pairs to be finally welded. Since their contact surfaces have not been carbonized during the heat treatment, on account of the previous protection of the welding zone, this welding can be carried out directly by means of electron or laser beams, as before, so that under the action of the fusion and vaporization of the metal, which takes place at the welding zone, a secure welded connection of the two workpieces is produced.

I claim:

1. A method of making a surface hardened composite welded metal article, comprising:

(a) finish machining weldable contact surfaces on mateable metal workpieces to be joined;

(b) mating said workpieces to intimately join said contact surfaces for defining a welding zone;

(c) providing a groove along the exposed extremities of said contact surfaces and sealing off said welding zone by depositing a nonhardening and removable agent in said groove to prevent ingress of gases;

(d) gas carburizing the mated workpieces for surface hardening;

(e) separating the surface hardened workpieces for machining to a desired configuration; and (f) after rejoining said workpieces, fusing said contact surfaces by welding.

2. The method as in claim 1, in which said agent is selected from the group consisting of high temperature resistant oil/sand mixture, high temperature microcrystalline wax, high temperature resistant lacquer, and ceramic paint.

3. In a method of producing composite welded components joined together from at least two metal workpieces, in which the workpieces are heat treated for hardening their surface prior to welding their contact surfaces forming a welding zone and are machined before and/or after the heat treatment, the improvement comprising:

(a) joining the workpieces together prior to said heat treatment, said workpieces being partially machined prior to being joined together in order to produce enlarged covering surfaces at least on the edges of their contact surfaces forming the ends of the welding zone which are to be covered; and (b) protecting the extremities of the welding zone formed upon bringing together of said workpieces by providing a groove along the exposed extremities of said zone and depositing an agent in said groove which prevents carbonization of the contact surfaces of the workpieces during the subsequent heat treatment.

4. The method as in claim 3, in which the workpieces are individually finished after the heat treatment and prior to welding.

5. The method as in claim 3, in which said method is applied to the coaxial welding of two gearwheels of a transmission for a motor vehicle and in which there is an axial series arrangement of toothed rims of said gearwheels, the hub of one gearwheel being only partially machined to mount on the hub of the second gearwheel and likewise the second gearwheel is only partially machined at a stop position on a shoulder thereof, the welding zone formed by the two hubs being enlarged by use of a groove on end faces of the two hubs in a common radial plane for covering by the agent which prevents carbonization, the two gearwheels being separated from one another again for individual machining after heat treatment and prior to being welded.

* * * * *